United States Patent [19]

Benson

[11] Patent Number: 4,512,150

[45] Date of Patent: Apr. 23, 1985

[54] CONSTANT TEMPERATURE ELEMENT

[75] Inventor: Glendon M. Benson, Danville, Calif.

[73] Assignee: New Process Industries, Inc., Minneapolis, Minn.

[21] Appl. No.: 518,516

[22] Filed: Jul. 29, 1983

Related U.S. Application Data

[63] Continuation-in-part of Ser. No. 244,941, Mar. 18, 1981, Pat. No. 4,446,698, and Ser. No. 292,771, Aug. 14, 1981, abandoned.

[51] Int. Cl.[3] ..... F02G 1/00

[52] U.S. Cl. ..... 60/526; 60/517; 62/6; 165/165

[58] Field of Search ..... 60/517, 524, 525, 526; 62/6; 165/165

[56] References Cited

U.S. PATENT DOCUMENTS 1,290,756 1/1919 Kasley ..... 60/526
2,064,187 12/1936 White et al. ..... 165/165 X
3,583,155 6/1971 Schuman ..... 60/526 X
4,446,698 5/1984 Benson ..... 60/526 X

FOREIGN PATENT DOCUMENTS 126969 5/1947 Australia .

*Primary Examiner*—Stephen F. Husar
*Attorney, Agent, or Firm*—Townsend and Townsend

[57] ABSTRACT

A constant temperature element for heating or cooling a working gas to the temperature of a control fluid is disclosed. The element includes a plurality of hollow concentric tapered rings of conductive material having a serrate configuration in section with tips projecting into the working fluid. A plate is typically attached to and generally flush with the base of the rings except for a central elongate plenum spanning the rings and having inlet and outlet ends respectively and a barrier at the center. The temperature control fluid enters at the inlet of the plenum so that it circulates through the rings and exits through the outlet of the plenum to maintain the rings, and thereby the working fluid adjacent the rings, at the temperature of the temperature control fluid.

34 Claims, 9 Drawing Figures

CONSTANT TEMPERATURE ELEMENT

This application is a continuation-in-part of my co-pending application entitled "Isothermalizer System", Ser. No. 06/244,941, filed 3/18/81, now U.S. Pat. No. 4,446,698, continuation-in-part of my co-pending application entitled "Solar Powered Free Piston Stirling Engine", Ser. No. 06/292,771, filed 8/14/81, now abandoned.

BACKGROUND OF THE INVENTION

The maximum efficiency of a heat engine, given by the Carnot efficiency, can only be achieved if expansion and compression of a working fluid in a variable volume chamber are carried out as nearly isothermally (i.e., at a constant temperature) as possible. The desirability of isothermal expansion and compression is also manifest in a heat pump cycle where it is desired to achieve a coefficient of performance that approaches the Carnot limit. Similarly, a gas compressor can be operated with a minimum amount of work if the compression is carried out isothermally. However, where the volume of working fluid is large, or when the cycle frequency is high, the ideal condition of isothermal expansion and compression is difficult to achieve.

In the past, it has been a practice to use external heat exchangers through which the working fluid is flowed during its expansion and compression. However, external heat exchangers are complex devices which add to the expense and size of the machines. Furthermore, a dead volume is inherent in the use of such external heat exchangers, requiring a larger displacement for a given capacity and pressure ratio. Moreover, the external heat exchangers are sources of axial (thermal shunt) losses due to their cross section.

Isothermalizing of work chambers has always been the goal in the development of highly efficient heat engines such as those employing a Stirling or Ericsson engine. Apparently, some sort of isothermalizing system is employed in the early development of such engines, as indicated in "Napier and Rankine's patent Hot-Air Engines", *Mechanics Magazine*, No. 1628, Oct. 21, 1854. A patent to Dineen, U.S. Pat. No. 3,220,178, suggests the use of a flexible cloth. In a paper in the Intersociety Energy Conversion Engineering Conference proceedings, Aug. 20, 1973, page 198, entitled "Thermal Losses In Gas-Charged Hydraulic Accumulators" by Professor David R. Otis (University of Wisconsin), the use of a flexible polyurethane foam is suggested. In all these systems, apparently the object was to utilize a flexible material which changed its size and shape in accordance with chamber volume. However, such systems have proved to be very inefficient in actually achieving isothermalization, and the use of heat exchangers is still necessary.

SUMMARY OF THE INVENTION

The present invention provides a constant temperature element for heating or cooling a working gas to the temperature of a control fluid. The element includes a plurality of hollow concentric tapered rings of conductive material having a serrate configuration in section with tips projecting into the working fluid. A plate is typically attached to and generally flush with the base of the rings except for a central elongate plenum spanning the rings and having inlet and outlet ends respectively and a barrier at the center. The temperature control fluid enters at the inlet of the plenum so that it circulates through the rings and exits through the outlet of the plenum to maintain the rings, and thereby the working fluid adjacent the rings, at the temperature of the temperature control fluid.

The constant temperature element of the present invention is generally used with a meshing element having concentric tapered projections complementary to the concentric rings of the element. The constant temperature element may have apertures at the base of the rings and in the plate to allow the working fluid to penetrate the element. In certain systems, a pair of constant temperature elements may be mounted back to back to a regenerator, with the working fluid passing through the elements and the regenerator, one element acting to heat the working fluid and the other element acting to cool the working fluid.

The constant temperature element of the present invention is an extremely effective device for exchanging heat with a working fluid at a constant temperature. This goal is essential to the efficient working of various types of sophisticated engines, such as a Stirling or Ericsson engine. The efficiency of this constant temperature element allows the construction of Stirling and Ericsson engines and other such devices with overall efficiencies which approach the design goal of Carnot efficiency.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 3:
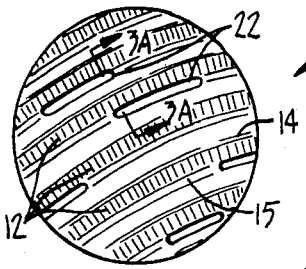
FIG. 3 is an enlarged fragmentary section view taken along lines 3—3 of FIG. 2.
Figure 3A:
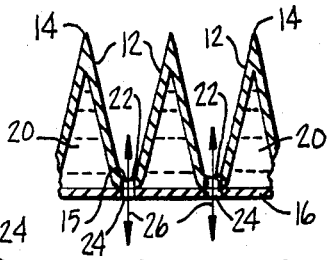
FIG. 3A is an enlarged section view taken along lines 3A—3A of FIG. 3.
Figure 2:
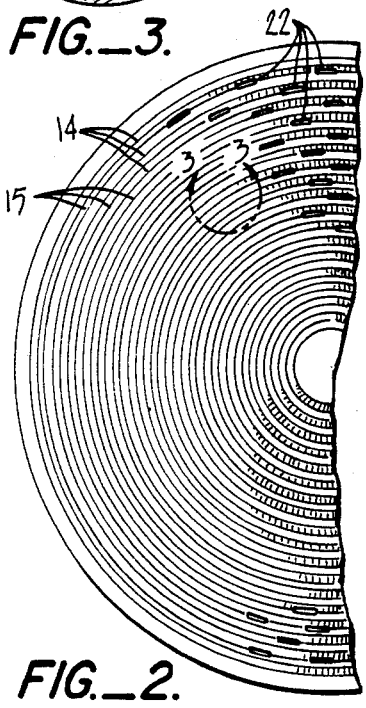
FIG. 2 is a fragmentary front elevation view of the front face of the preferred embodiment of FIG. 1.
Figure 4:
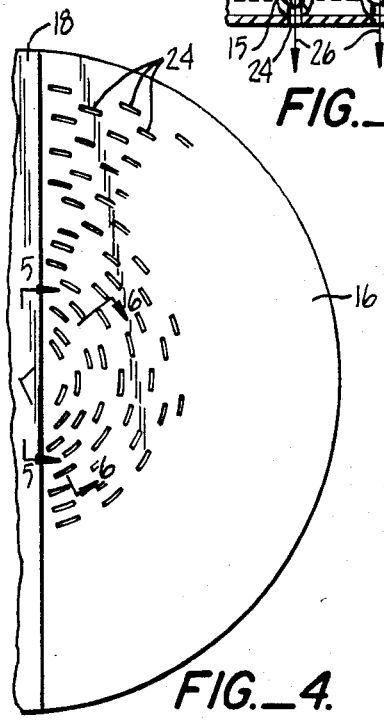
FIG. 4 is a fragmentary elevation view of the back face of the embodiment of FIG. 1.
Figure 6:
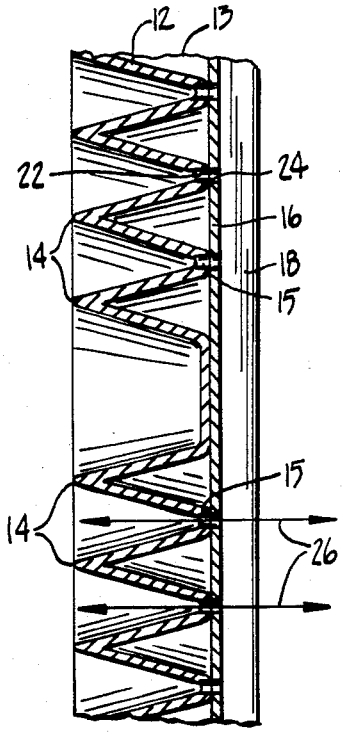
FIG. 6 is an enlarged fragmentary section view taken along lines 6—6 of FIG. 4.
Figure 5:
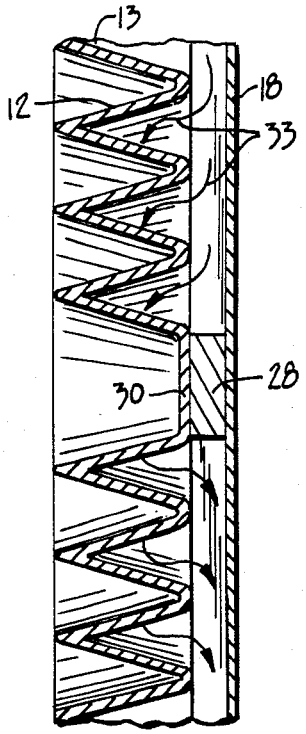
FIG. 5 is an enlarged fragmentary section view taken along lines 5—5 of FIG. 4.

The preferred embodiment 10 of the constant temperature element of the present invention is illustrated by way of reference to FIGS. 1-6 in combination. Element 10 includes a plurality of concentric tapered rings 12 formed in a single sheet 13 of thin metallic or ceramic material which is heat conductive. When viewed in section as in FIG. 3A, rings 12 have a serrate configuration, with tips 14 and bases 15. When viewed in elevation, FIG. 3 shows adjacently facing ring 12 surfaces as cross-hatched and uncross-hatched, respectively. The thickness of material 13 is preferably on the order of about 0.005–0.020 inches, and in one preferred design the height of each ring from base 15 to tip 14 is 0.415 inches, and the lateral spacing from tip to tip is 0.1 inches. The tapered rings thus have a relatively high "aspect ratio", i.e., the ratio of the height of the ring to its maximum thickness.

The base 15 of each ring 12 is flush with a plate 16 which is flat except for a raised diagonal plenum section 18. Plate 16 is attached to rings 12 by soldering, brazing, welding, or the like to maintain the plate flush with the bases 15 of the rings.

The hollow interior of tapered rings 12 may be left vacant, but is preferably filled with a porous heat conductive material of composition similar to that of sheet 13, such as reticulated nickel or reticulated silicon nitride 20. The term "hollow" is used in the context of the present invention to denote either an open space, or a space filled with a permeable material which may be different from that of an impermeable surrounding structure.

A plurality of apertures 22 are formed at spaced circumferential positions in the bases 15 of rings 20, where the rings are flush with plate 16. Corresponding apertures 24 are formed in plate 16, leaving an opening for the passage of a fluid completely through rings 12 and plate 16, as illustrated by arrows 26 in FIG. 3A and FIG. 6, without entering the hollow interior space of the rings. The hollow interior of rings 12 is sealed by plate 16 except at plenum section 18, where a spacing exists between the rings and the plate.

Plenum section 18 has a central barrier 28 which blocks the plenum at the location of the flat hub 30 of rings 12. A temperature control fluid, preferably at a constant temperature, enters plenum section 18 at one end, as illustrated by arrow 32. Because of central barrier 28, the temperature control fluid cannot flow directly through the plenum, but enters the space defined by rings 12 and flat plate 16 (see arrow 33 in FIG. 5), and flows circumferentially around the rings, as illustrated by arrow 34. The temperature control fluid is collected at the far end of plenum 18, and exits the plenum as illustrated by arrow 36.

Figure 1:
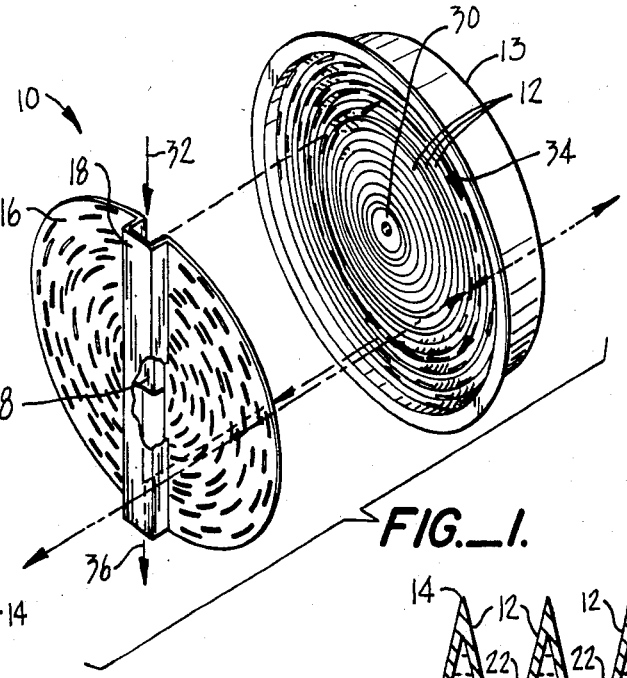
FIG. 1 is an exploded view of the preferred embodiment of the present invention.
Figure 7:
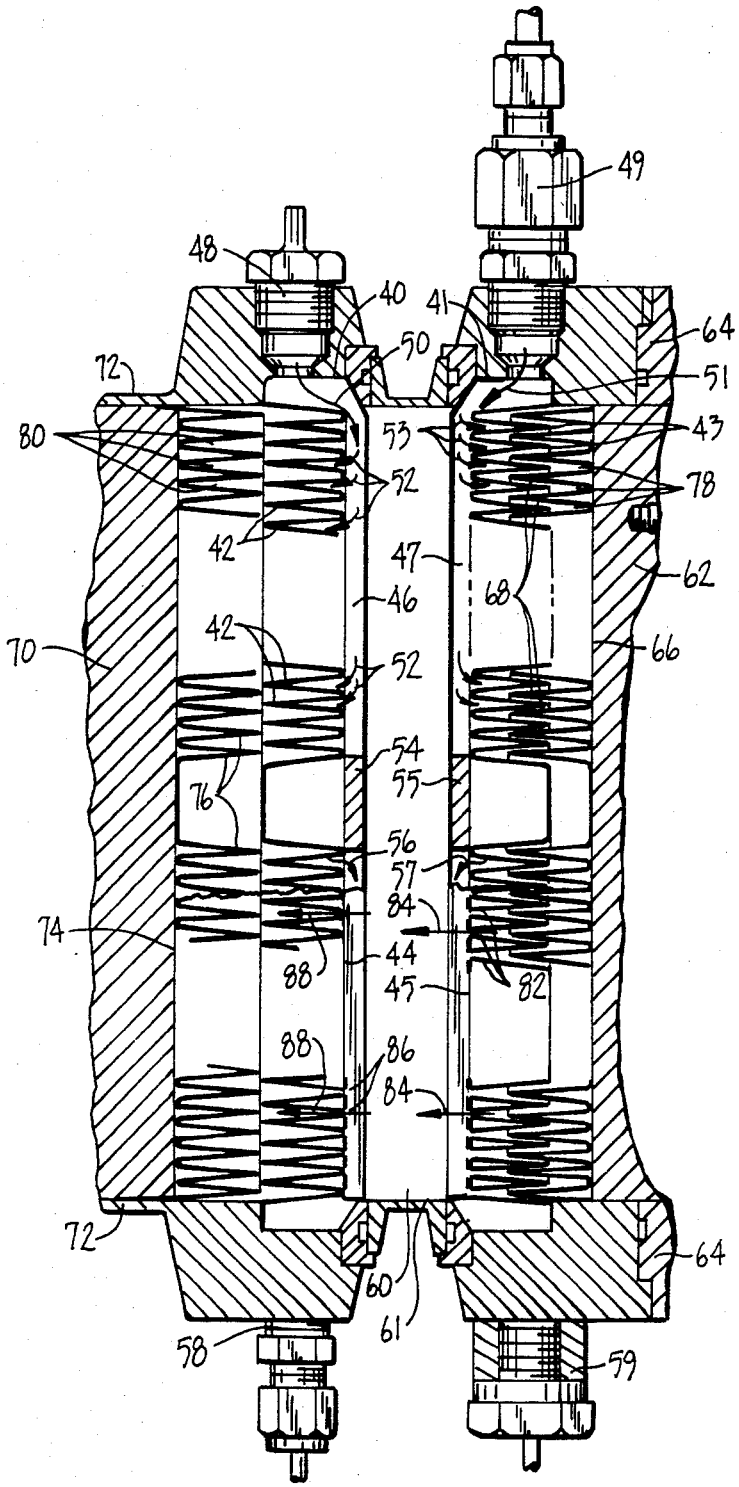
FIG. 7 is a schematic view of a portion of a heat exchange mechanism employing the present invention.

A potential use of the embodiment of FIG. 1 is illustrated in FIG. 7, where a pair of temperature control elements 40, 41 are utilized in a heat engine, where temperature control element 40 is associated with the expansion section of the engine and temperature control element 41 is associated with the compression section of the engine. Temperature control element 40, operating at a temperature higher than that of element 41, includes a plurality of concentric tapered hollow rings 42 mounted to plate 44 which is flat except for central plenum section 46. In the top portion of FIG. 7, the section is taken along plenum 46, whereas in the bottom portion the section is taken out of the plane of the plenum. Inlet fitting 48 provides a heat addition (heating) fluid to plenum 46, as illustrated by arrow 50. The heating fluid flows from the plenum into the hollow interior of rings 42, as illustrated by arrows 52, around the circumference of the rings, and back into plenum 46 beyond central barrier 54, as illustrated by arrow 56. The heating fluid exits plenum 46 through fitting 58. Rings 42 are thus maintained in their entirety at substantially the temperature of the heating fluid.

Constant temperature element 41 is essentially a mirror image of element 40, including a plurality of concentric tapered rings 43 mounted to a flat plate 45 having diagonal plenum 47. A heat rejection (cooling) fluid enters through fitting 49 into plenum 47, as illustrated by arrow 51. The cooling fluid enters the hollow interior of rings 43, as illustrated by arrows 53, flows circumferentially around the rings, and exits at the far side of central barrier 55, as illustrated by arrow 57. The cooling fluid then exits plenum 47 through fitting 59, maintaining concentric tapered rings 43 at substantially the temperature of the cooling fluid.

The space 60 between constant temperature elements 40 and 41 is filled with a heat retentive material, such as reticulated silicon carbide, stacked copper screens, or the like, to form a regenerator.

A compressor piston 62, motivated by external forces, reciprocates in a cylinder 64. The face 66 of cylinder 62 confronting constant temperature element 41 has a plurality of ridges 68, which are complementary to and nest within hollow concentric rings 43. Piston 62 is shown in FIG. 7 as approaching its left dead center position, at which point ridges 68 will fully mesh with rings 43 so that virtually no dead volume remains.

An expander piston 70, which is separately "driven" by external forces in the embodiment of FIG. 7, reciprocates in cylinder 72. The face 74 of piston 70 confronting constant temperature element 40 has a plurality of concentric tapered ridges 76 which are complementary to rings 42, so that when fully nested, virtually no dead volume remains between the rings and the ridges.

A working fluid is located in the space 78 between rings 43 and ridges 68, the corresponding space 80 between rings 42 and ridges 76, and in the porous regenerator 60. As piston 62 moves toward its left dead center position, the working fluid is compressed by the piston, and cooled by constant temperature element 41, to undergo part of a thermodynamic cycle. The pressure increase is relieved to some extent by the passage of the working fluid through the apertures 82 between rings 43 and in plate 46, as illustrated by arrow 84. The working fluid cools the right side of regenerator 60, and is in turn heated by heat exchange with the regenerator. A portion of the working fluid passes through apertures 86 in plate 44, and between rings 42, as illustrated by arrow 88, and into the space 80 between rings 42 and expander piston 70. The expander piston then moves to the left, expanding the fluid in space 80, thereby removing heat from rings 42 and fluid contained in space 52.

When piston 70 reaches its left dead center position, it returns to the right, displacing the working fluid in space 80, and forcing it through regenerator 60 and into space 78, during which the working fluid is first cooled by the regenerator and then cooled by constant temperature element 41. Piston 62 returns to the right, and the working fluid completes its Stirling thermodynamic cycle. In the course of the Stirling thermodynamic cycle, heat has been exchanged by the working fluid with the cold and hot fluids nearly isothermally at the walls of concentric tapered rings 42 and 43 respectively, greatly increasing thermodynamic efficiency, and approaching the ideal Carnot efficiency for a Stirling-type engine.

The embodiment of FIG. 1, as illustrated in FIG. 7, will function alternately as a heat pump when temperature control element 40, associated with the expansion section of the machine, operates at a temperature lower than the temperature of element 41, which is associated with the compression section of the machine, as is well known to those skilled in the art. In this heat pump operating mode the above described sequence is thermodynamically reversed, resulting in heat being added isothermally to the working fluid by constant temperature element 40 operating at a temperature lower than element 41, and heat being withdrawn isothermally from the working fluid by constant temperature element 41, while regenerator 60 provides thermal regeneration for the working fluid flowing therethrough, thereby approaching the ideal Carnot efficiency for a Stirling-type heat pump.

The embodiment shown in FIG. 7 may be altered without changing the thermodynamic characteristics of the machine, by rigidly attaching ends 70 and 62 to the stationary structure of the machine and then reciprocating in common bore 61 the displacer structure formed by ring elements in 40 and 41 and regenerator 60, where reciprocation of displacer structure is provided by external forces. In this alternate embodiment, the function of rings 42 and 76 are reversed as is the function of rings 68 and 82, in that the heat exchange circulating fluid provided by fitting 48 now flows through interior of rings 76 and exits through fitting 58, and heat exchange circulating fluid provided by fitting 49 now flows through interior of rings 68 and exits through fitting 59.

Figure 8:
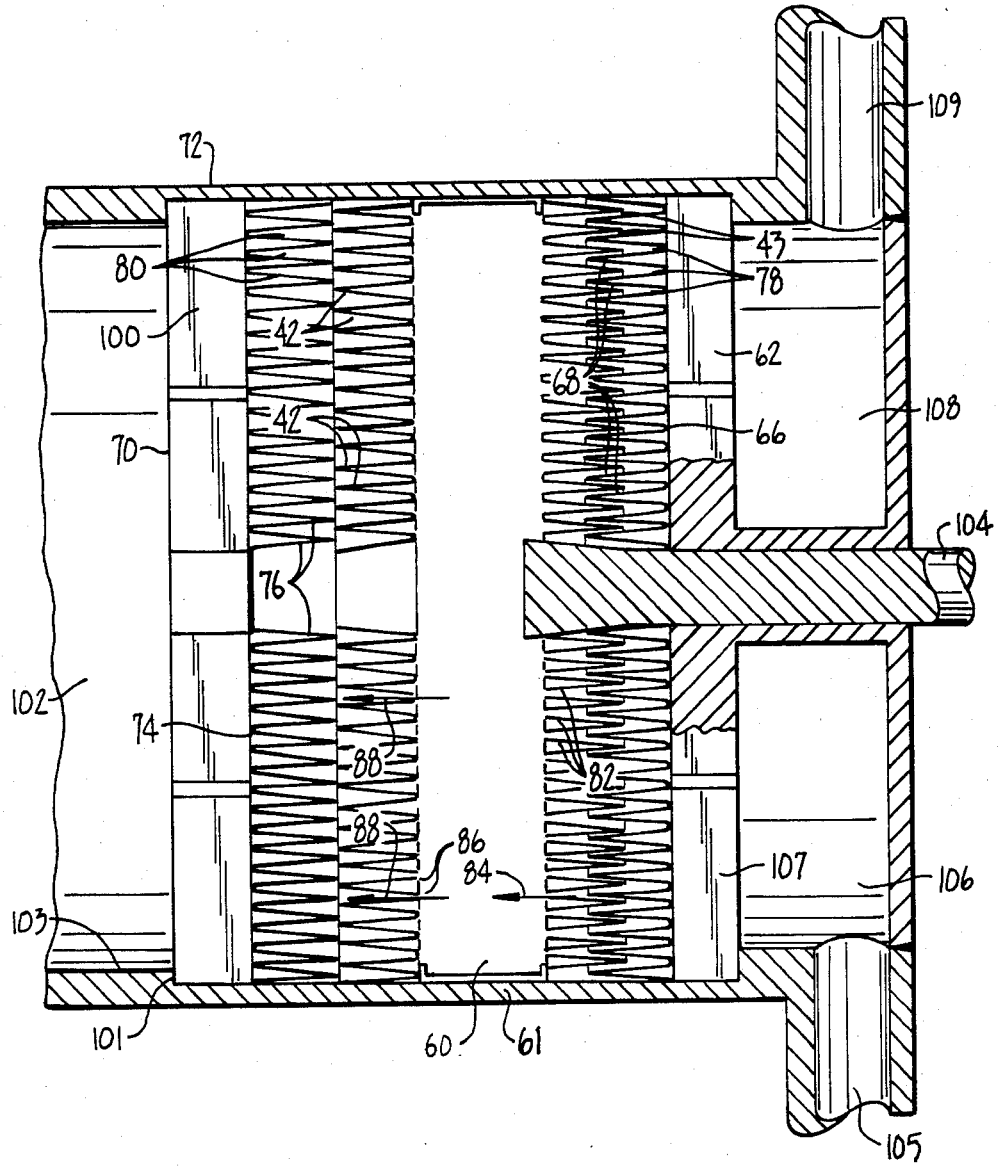
FIG. 8 is a schematic view of a portion of a heat exchange mechanism employing an alternative embodiment of the present invention

An alternate embodiment of that shown in FIG. 7 is illustrated in FIG. 8, where piston 70 is replaced with a radial strut structure 100 that is supported by lip 101 of cylinder 72. Open plenum 102 forms an axial conduit for transport of phase change control fluid from a heat means to the fluid conducting strut structure, which in turn is in fluid communication with stationary rings 76 that are sealed to cylinder wall 72. In the engine embodiment shown in FIG. 8, control fluid is vaporized at a remote heat source means and flows through open plenum 102, strut support structure 100, to interior of rings 76 where the control fluid vapor condenses. The condensed control fluid then flows back to heat source means by capillary action induced by wicked surface 103 on radial strut structure and on interior of cylinder 72. In this embodiment, rings 42, regenerator 60, and rings 82 form a displacer driven by drive rod 104 and reciprocal in cylinder bore 61. Heat rejection occurs by transport of phase change control fluid flowing in liquid state through fitting 105 into plenum 106 through fluid conducting radial strut supports 107 into interior of rings 68, sealed to cylinder wall 72, where the control fluid vaporizes and then flows through outlet plenum 108 and exit fitting 109.

The principles of the present invention may be employed in various ways to achieve heat exchange efficiency in a heat engine, heat pump or compressor. However, it is to be expressly understood that such modifications and adaptations are within the spirit and scope of the present invention, as set forth in the following claims.

I claim:

1. A constant temperature element for heating or cooling a working gas to the temperature of a control fluid, said element comprising:

a plurality of hollow concentric tapered rings of heat conductive material having a serrate configuration in section with tips projecting into the working fluid;

means for enclosing the bases of the rings except for a plenum spanning the rings and having inlet and outlet ends respectively and a barrier at the center; and means for flowing the temperature control fluid into the inlet end of the plenum so that the control fluid circulates through the rings and exits through the outlet end of the plenum to maintain the rings, and thereby the working fluid adjacent the rings, at substantially the temperature of the temperature control fluid.

2. An element as recited in claim 1 wherein the concentric tapered rings are filled with porous material.

3. The element of claim 1 and additionally comprising a cylinder housing the concentric tapered rings, and a piston which reciprocates in the cylinder and has a complementary serrate configuration which nests with the concentric tapered rings.

4. The element of claim 1 wherein the enclosing means comprises a plate flush with the bases of the rings except for a central elongate plenum.

5. The element of claim 4 wherein the bases of the rings and the plate have apertures to allow the working fluid to pass through the ring, and plate.

6. The element of claim 5 and additionally comprising a pair of such concentric tapered rings and plates mounted back to back, and additionally comprising a porous regenerator between the respective plates, so that the working fluid passes through the apertures in the plates and through the regenerator.

7. The element of claim 6 wherein the temperature control fluid of one plate and rings heats the working fluid, and the temperature control fluid of the other plate and rings cools the working fluid.

8. The element of claim 1 wherein the temperature control fluid comprises a phase change material at its phase change temperature.

9. The element of claim 1 wherein the rings are constructed of thin metal having a constant thickness.

10. The element of claim 1 wherein the rings are constructed of thin ceramic.

11. A constant temperature element for heating or cooling a working gas to the temperature of a control fluid, said element comprising:

a plurality of hollow concentric tapered rings of heat conductive material having a serrate configuration in section with tips projecting into the working fluid;

means for supporting the bases of the rings wherein said means is flow conductive to the control fluid, and has inlet and outlet means for conducting the control fluid to and away from the rings; and means for flowing the temperature control fluid into the inlet of the ring support means so that the control fluid contacts the rings and then exits through the outlet of the ring support means to maintain the rings, and thereby the working fluid adjacent the rings, at substantially the temperature of the temperature control fluid.

12. The element of claim 11 wherein the temperature control fluid comprises a phase change material at its phase change temperature.

13. The element of claim 11 wherein the inlet and outlet means comprises a heat pipe for transport of a phase change material.

14. An isothermalizing system comprising:

a temperature control fluid;

a constant temperature element including a chamber for the temperature control fluid and a thermally conductive wall at least partially defining said chamber, said thermally conductive wall comprising a plurality of concentric tapered hollow rings of heat conductive material;

a meshing element juxtaposed to the heat conductive wall of the constant temperature element and including concentric tapered rings complementary to those of the constant temperature element;

a working fluid between the thermally conductive wall and the meshing element; and means for moving the thermally conductive wall of the constant temperature element and the meshing element toward and away from one another to cause the working fluid to undergo a thermodynamic cycle during which it receives or discharges heat at the thermally conductive wall at substantially the temperature of the temperature control fluid.

15. The system of claim 14 wherein the constant temperature element is stationary, and the meshing element moves relative to the constant temperature element.

16. The system of claim 14 additionally comprising a cylinder, and wherein the constant temperature element is formed in the cylinder with the thermally conductive wall spanning the cylinder, and the meshing element comprises a piston which reciprocates in the cylinder.

17. The system of claim 16 wherein the moving means comprises a crankshaft attached to the piston.

18. The system of claim 14 wherein the thermally conductive wall includes apertures at the base of the tapered rings to allow the working fluid to pass through the wall.

19. The system of claim 14 wherein the constant temperature element includes a plate flush with the base of the concentric tapered rings, and a plenum raised relative to the plate and spanning the rings, the plate, rings and plenum in combination defining the chamber.

20. The system of claim 19 wherein the plenum extends from one edge of the rings to an opposite edge of the rings, having an inlet at one end and an outlet at the other end and a central plug, so that the temperature control fluid flows in through the inlet, around through the rings and out the outlet.

21. The system of claim 19 wherein the plate and the tapered rings in the constant temperature element include apertures allowing the working fluid to pass through the constant temperature element without entering the chamber.

22. The system of claim 14 wherein the concentric tapered rings of the meshing element are solid.

23. The system of claim 14 wherein the tapered rings of the constant temperature element are filled with a material porous to the temperature control fluid.

24. The system of claim 14 wherein the temperature control fluid comprises a phase change material maintained at the phase change temperature of the fluid.

25. A heat exchange element for heating and cooling a working fluid, said element comprising:

a heat regenerator having a hot side and a cold side;

a pair of constant temperature elements mounted to the hot and cold sides respectively of the heat regenerator, each constant temperature element including a plate mounted to the regenerator, a plurality of hollow concentric tapered rings of heat conductive material projecting outwardly from the plate, and apertures in the base of the rings and plates for passage of the working fluid;

means for flowing a cooling fluid through the interior of the rings on the cold side of the regenerator and a heating fluid through the interior of the rings on the hot side of the regenerator; and means for pressurizing and depressurizing the working fluid on opposite sides of the regenerator external to the rings so that the working fluid flows through the regenerator and constant temperature elements, the working fluid being heated at the hot side of the regenerator and cooled at the cold side of the regenerator.

26. The element of claim 25 wherein the plate of each constant temperature element includes a diagonal plenum spanning the rings and having an inlet at one end, an outlet at the other end, and a barrier at the center, and wherein the flowing means comprises means for flowing cooling fluid into one end of the inlet of the plenum of the constant temperature element on the cold side of the regenerator so that it flows around the interior of the rings and out the other end of the plenum, and means for flowing a heating fluid into one end of the plenum of the constant temperature element on the hot side of the regenerator so that the heating fluid flows through the interior of the rings and out the other end.

27. The element of claim 25 wherein the pressurizing and depressurizing means comprises pistons on opposite sides of the regenerator.

28. The element of claim 25 wherein the rings are filled with material porous to the heating and cooling fluids.

29. A heat exchange assembly for heating and cooling a working fluid, said assembly comprising:

a cavity having a hot side, a cold side, and a common bore connecting said hot and cold sides;

a pair of constant temperature elements mounted to the hot side and cold side respectively of the cavity, each constant temperature element including a plate mounted to the respective cold and hot sides of the cavity, a plurality of hollow concentric tapered rings of heat conductive material projecting into the cavity from the plate, and apertures in the base of the rings and at least one plate for passage of the working fluid;

a displacer element reciprocal in common bore of cavity comprising: (1) a heat regenerator having a hot side and a cold side, respectively adjacent the hot and cold sides of cylindrical cavity; (2) a pair of constant temperature elements mounted to the hot and cold sides respectively of the heat regenerator, each constant temperature element including a plate mounted to the regenerator, a plurality of hollow concentric tapered rings of heat conductive material projecting outwardly from the plate, and apertures in the base of the rings and plates for passage of the working fluid;

means for flowing a cooling fluid through the interior of the rings on the cold side of the cylindrical cavity and a heating fluid through the interior of the rings on the hot side of the cylindrical cavity;

means for reciprocating displacer element in cylindrical cavity so as to provide alternate meshing of displacer-mounted cold constant temperature element with cylinder-mounted cold side constant temperature element and of displacer-mounted hot constant temperature element with cylinder-mounted hot side constant temperature element; and means for pressurizing and depressurizing the working fluid on opposite sides of the regenerator external to the displacer-mounted rings so that the working fluid flows through the regenerator and constant temperature elements, the working fluid being heated at the hot side of the regenerator and cooled at the cold side of the regenerator.

30. The cylinder mounted element of claim 29 wherein the plate of at least one cylinder mounted element includes an outwardly projecting diagonal plenum spanning the rings and having an inlet at one end, an outlet at the other end, and a barrier at the center, and wherein the flowing means comprises means for flowing heat transfer fluid into one end of the inlet of the plenum of the cylinder mounted element so that said fluid flows around the interior of the rings and out the other end of the plenum.

31. The cylinder mounted element of claim 29 wherein the plate of at least one cylinder mounted element includes an outwardly projecting open plenum of radial strut configuration that mates to one cavity end wherein said cavity end contains a fluid conduit means for transporting a phase-change heat exchange fluid axially through the plenum and plate to the interior of the rings where the heat exchange fluid changes phase by heat exchange with said rings and for transporting the phase-changed heat exchange fluid axially from the plenum.

32. In claim 29 wherein said heating fluid is cooled by the working fluid and said cooling fluid is heated by the working fluid so as to effect a heat pump function.

33. In claim 31 wherein said fluid means is a heat pipe.

34. A heat exchange assembly for heating and cooling a working fluid, said assembly comprising:

a cavity having a movable hot side, a movable cold side, and a common bore connecting said hot and cold sides, wherein said movable hot side comprises a hot piston crown and said movable cold side comprise a cold piston crown;

a pair of constant temperature elements mounted to the hot and cold side respectively of the cavity, each constant temperature element including a plate mounted to the respective cold and hot sides of the cavity, and a plurality of hollow concentric tapered rings of heat conductive material projecting into the cavity from the plate;

a heat regenerator having a hot side and a cold side respectively adjacent the movable hot side and movable cold side of the cavity;

a pair of constant temperature elements mounted to the hot and cold sides respectively of the heat regenerator, each constant temperature element including a plate mounted to the regenerator, a plurality of hollow concentric tapered rings of heat conductive material projecting outwardly from the plate, and apertures in the base of the rings and plates for passage of the working fluid;

means for flowing a cooling fluid through the interior of the rings on the cold side of the regenerator and a heating fluid through the interior of the rings on the hot side of the regenerator; and means for reciprocating the hot piston and cold piston so that the working fluid flows through the regenerator and constant temperature elements, the working fluid being heated at the hot side of the regenerator and cooled at the cold side of the regenerator.

* * * * *